US007614992B2

(12) United States Patent
Chandaria

(10) Patent No.: US 7,614,992 B2
(45) Date of Patent: Nov. 10, 2009

(54) CARTON HAVING INTERCONNECTED FLAPS

(75) Inventor: Kapoor Chandaria, Nairobi (KE)

(73) Assignee: Kitaru Innovations Inc., Lascelles, St. James (BB)

( * ) Notice: Subject to any disclaimer, the term of this patent is extended or adjusted under 35 U.S.C. 154(b) by 0 days.

(21) Appl. No.: 11/955,519

(22) Filed: Dec. 13, 2007

(65) Prior Publication Data

US 2009/0152337 A1 Jun. 18, 2009

(51) Int. Cl.

*B31B 1/88* (2006.01)
*B31B 1/26* (2006.01)
*B65D 5/10* (2006.01)

(52) U.S. Cl. ..... 493/55; 206/459.5; 229/125; 229/136

(58) Field of Classification Search ..... 229/125, 229/132, 136; 493/53, 55, 162, 167–174, 493/183; 206/459.5; 40/312

See application file for complete search history.

(56) References Cited

U.S. PATENT DOCUMENTS 1,765,104 A * 6/1930 Porter ..... 229/125
2,718,348 A * 9/1955 Montfort ..... 229/125
2,783,933 A * 3/1957 Sharts ..... 229/125
2,936,239 A * 5/1960 Rendall ..... 229/125
2,967,655 A * 1/1961 Seger, Jr. ..... 229/125
3,373,919 A * 3/1968 Schaich ..... 229/125
3,727,827 A * 4/1973 Stice ..... 229/125
4,019,673 A 4/1977 Salomons
4,059,221 A * 11/1977 Olson et al. ..... 229/125
4,887,766 A * 12/1989 Schoeneweis ..... 229/125
5,148,940 A * 9/1992 Mendise ..... 229/132
5,429,295 A 7/1995 Levy
5,476,218 A 12/1995 Reisman
5,752,650 A * 5/1998 Henderson ..... 229/125
6,918,503 B1 7/2005 Molander
6,926,153 B2 8/2005 Chandaria

FOREIGN PATENT DOCUMENTS

EP 0054275 4/1985
EP 1015353 11/2006
WO WO 2007/058613 5/2007

* cited by examiner

*Primary Examiner*—Gary E Elkins
(74) *Attorney, Agent, or Firm*—Sand & Sebolt

(57) ABSTRACT

A cardboard box with four side panels, four bottom flaps and four top flaps is provided. Adjacent bottom flaps and adjacent top flaps are provided with living hinges so that the flaps may be stored adjacent the body of the box. Additionally, during loading the top flaps are held adjacent the body of the box to move the flaps out of the way and make the box more convenient to load. The hinges may be broken apart to allow the flaps to be moved to the closed and sealed position.

13 Claims, 12 Drawing Sheets

CARTON HAVING INTERCONNECTED FLAPS

BACKGROUND OF THE INVENTION

1. Technical Field

The invention relates generally to shipping and storage boxes. More particularly, the invention relates to shipping and storage boxes which are shipped in a flat or unfolded configuration and are constructed at the time of use. Specifically, the invention relates to shipping and storage boxes of the type having an annular body and flaps extending outwardly from the body for closing the top and bottom thereof.

2. Background Information

Various types of boxes exist which may be manufactured of any flat material such as cardboard, and which are configured to efficiently fold into the final box shape. As people move about the country and the world, it becomes ever evident that the need for individuals to purchase and utilize storage and shipping boxes is ever increasing. However, boxes, even when stored and displayed in a flat, unassembled configuration still take up a significant amount of space. Additionally, the boxes tend to be relatively large when in the unassembled state, and the need thus exists for the creation of a box which takes up less shelf space when on display at a retail store, and which may be easily assembled by the user once purchased.

Separately, cardboard cartons or boxes which are purchased and are manually loaded generally include a plurality of flaps which extend upwardly into the air adjacent the sidewalls. These flaps can be cumbersome to work around when loading a box or carton for shipping or storage. While prior art boxes often include slots and holes formed in the body of the box for retaining the flaps in the down position, these holes weaken the box and allow entry of unwanted contaminates such as moisture, insects and animals. Additionally, these holes create weakness in the body of the box, subjecting the box to premature failure.

BRIEF SUMMARY OF THE INVENTION

The present invention provides a body having a pair of sidewalls and a pair of endwalls; each sidewall and each endwall having a top and bottom edge; four top flaps extending upwardly from the top edge of the body and four bottom flaps extending downwardly from the bottom edge of the body; and a first hinge extending between at least two of the top flaps or two of the bottom flaps.

The present invention further provides a method of making and loading a box comprising the steps of providing a box with a pair of endwalls and sidewalls and a flexible joint extending between each adjacent pairs of endwalls and sidewalls such that the first pair of joints are flat when the box is in a first collapsed position and the second pair of joints are bent when the box is in a first collapsed position; rotating the box to a second collapsed position wherein the first pair of joints are flat and the second pair of joints are bent; rotating the bottom flaps from a position adjacent the endwalls and sidewalls to a position away from the endwalls and sidewalls; erecting the box such that the sidewalls and endwalls are substantially 90° from each other; breaking the hinges connected adjacent bottom sidewall flaps and bottom endwall flaps; and rotating the bottom sidewall flaps and endwall flaps to a closed position.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
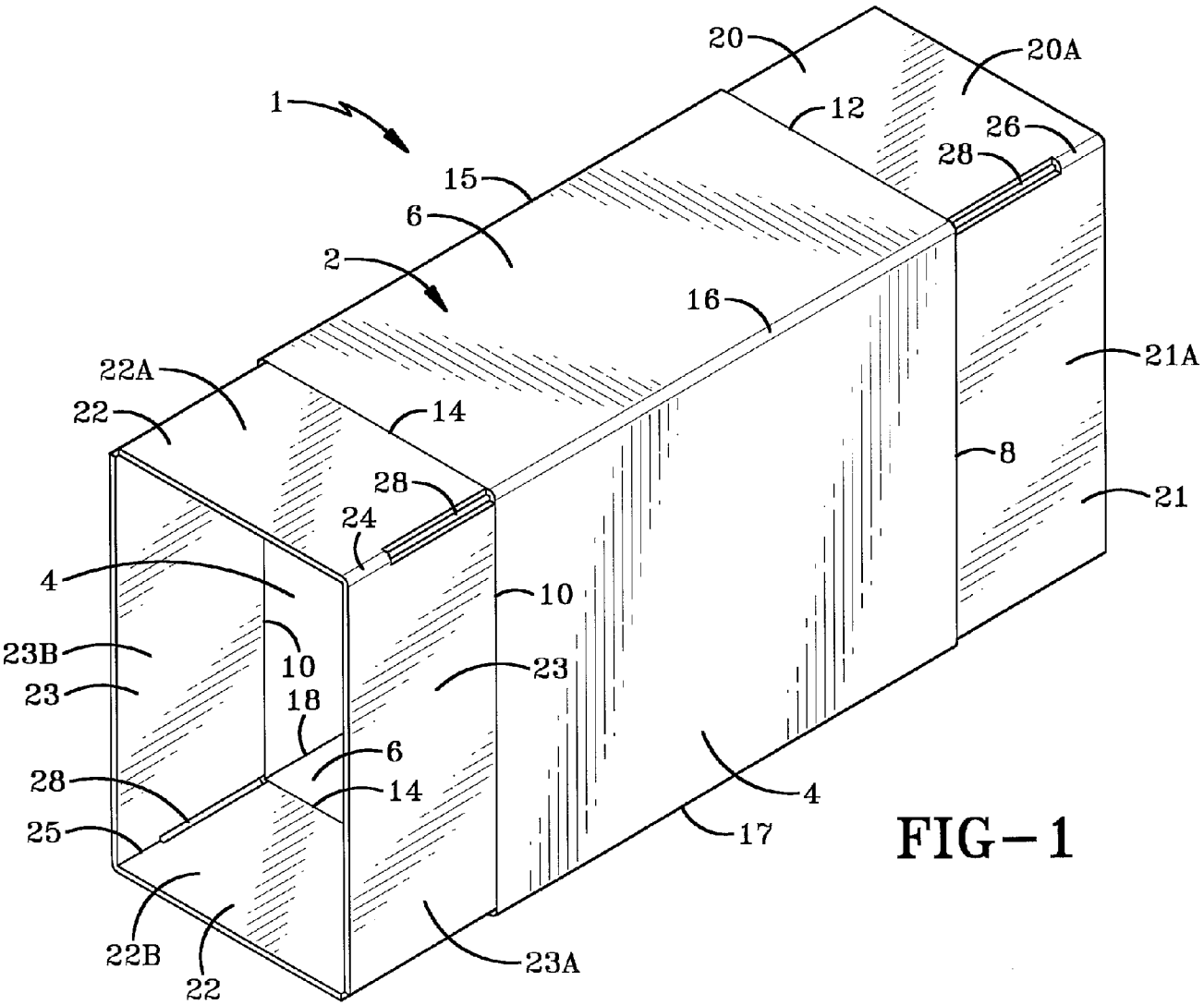
FIG. 1 is a perspective view of the box of the present invention.

The storage and shipping box of the present invention is indicated generally at the numeral 1, and is shown specifically in FIGS. 1-12. Box 1 generally includes a body 2 having a pair of parallel and spaced apart sidewalls 4 and a pair of parallel and spaced apart end walls 6. Each sidewall has a sidewall top edge 8 and a sidewall bottom edge 10. Similarly, each endwall has an endwall top edge 12 and an endwall bottom edge 14. Sidewalls 4 are joined to endwalls 6 by way of four joints, 15, 16, 17 and 18 respectively. Opposite pairs of joints, for example joints 15 and 17 make up a first pair of joints. Similarly, joints 16 and 18 make up a second pair of joints, the purpose for which will become more apparent hereinbelow.

Still referring to FIG. 1, a top endwall flap 20 extends outwardly from endwall top edge 12 of each endwall 6. Similarly, a top sidewall flap 21 extends outwardly from sidewall top edge 8 of each sidewall 4. Similarly, bottom endwall flap 22 extends outwardly from endwall bottom edge 14 of each endwall 6 and a bottom sidewall flap 23 extends outwardly from sidewall bottom edge 10 adjacent each sidewall 4.

In accordance with one of the primary features of the invention, joints 15 and 17 do not extend beyond body 2 of box 1. However, a portion of bottom endwall flap 22A and bottom sidewall flap 23A remain joined along joint 16 to form a first hinge 24. Bottom endwall flap 22B and bottom sidewall flap 23B also join along joint 18 to form a second hinge 25.

Figure 5:
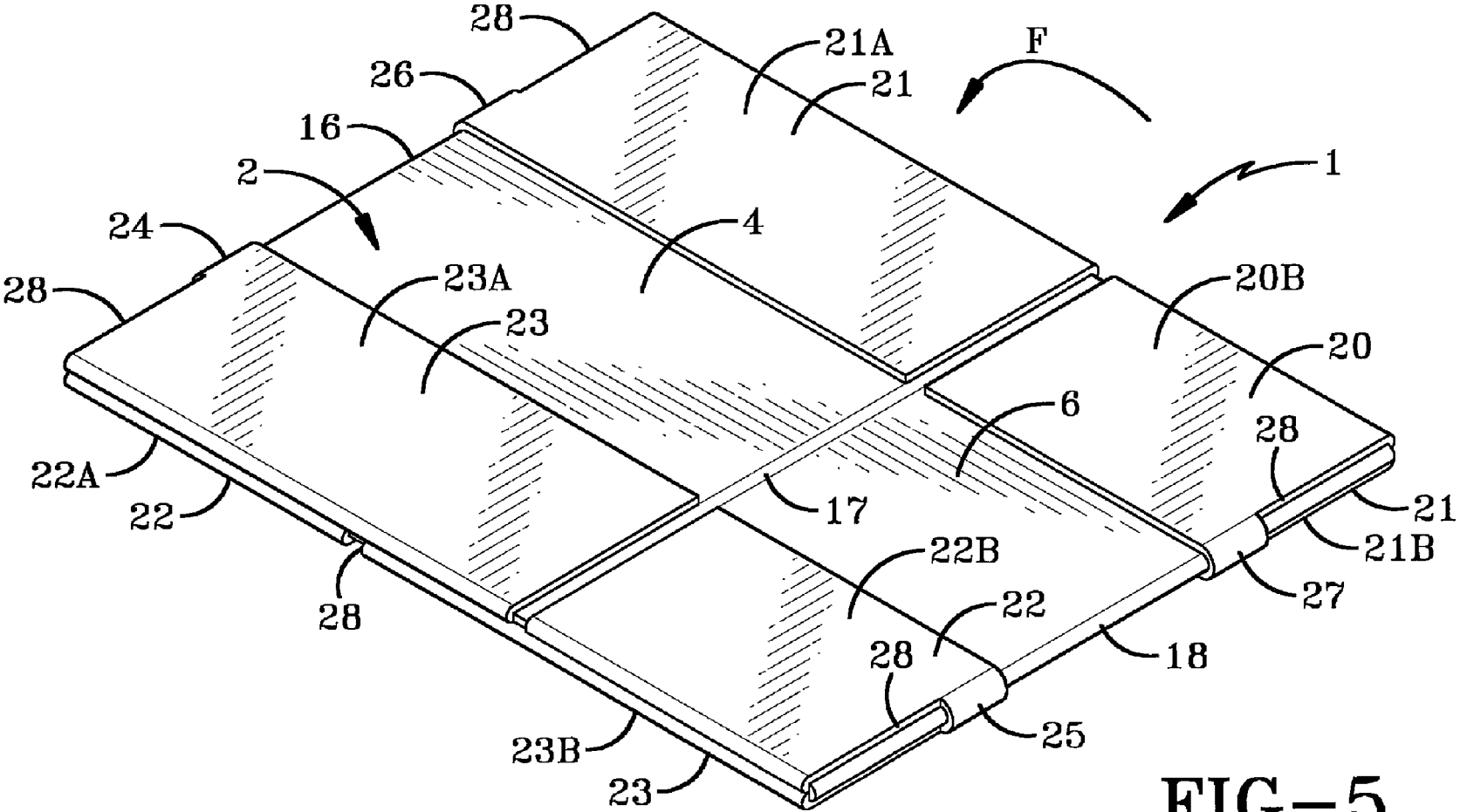
FIG. 5 is a perspective view of the box shown in FIG. 1, with the box rotated to retain the flaps against the body.

Top endwall flap 20A and top sidewall flap 21A also join along joint 16 to form a third hinge 26. Similarly, top endwall flap 20B and top sidewall flap 21B attach along joint 18 to form a fourth hinge 27 (FIG. 5). As is also evident from a review of FIG. 1, an unattached area 28 is positioned intermediate joint 16 and respective hinges 24 and 26, as well as intermediate respective hinges 25 and 27 and joint 18.

As is well-known in the art, box 1 may be made of a variety of materials including corrugated cardboard, non-corrugated paperboard, or a variety of wax-coated products including paper and plastic. Similarly, hinges 24, 25, 26 and 27 may have a variety of lengths without departing from the spirit of the present invention, but are preferably between ½ and 2 inches in length.

Figure 2:
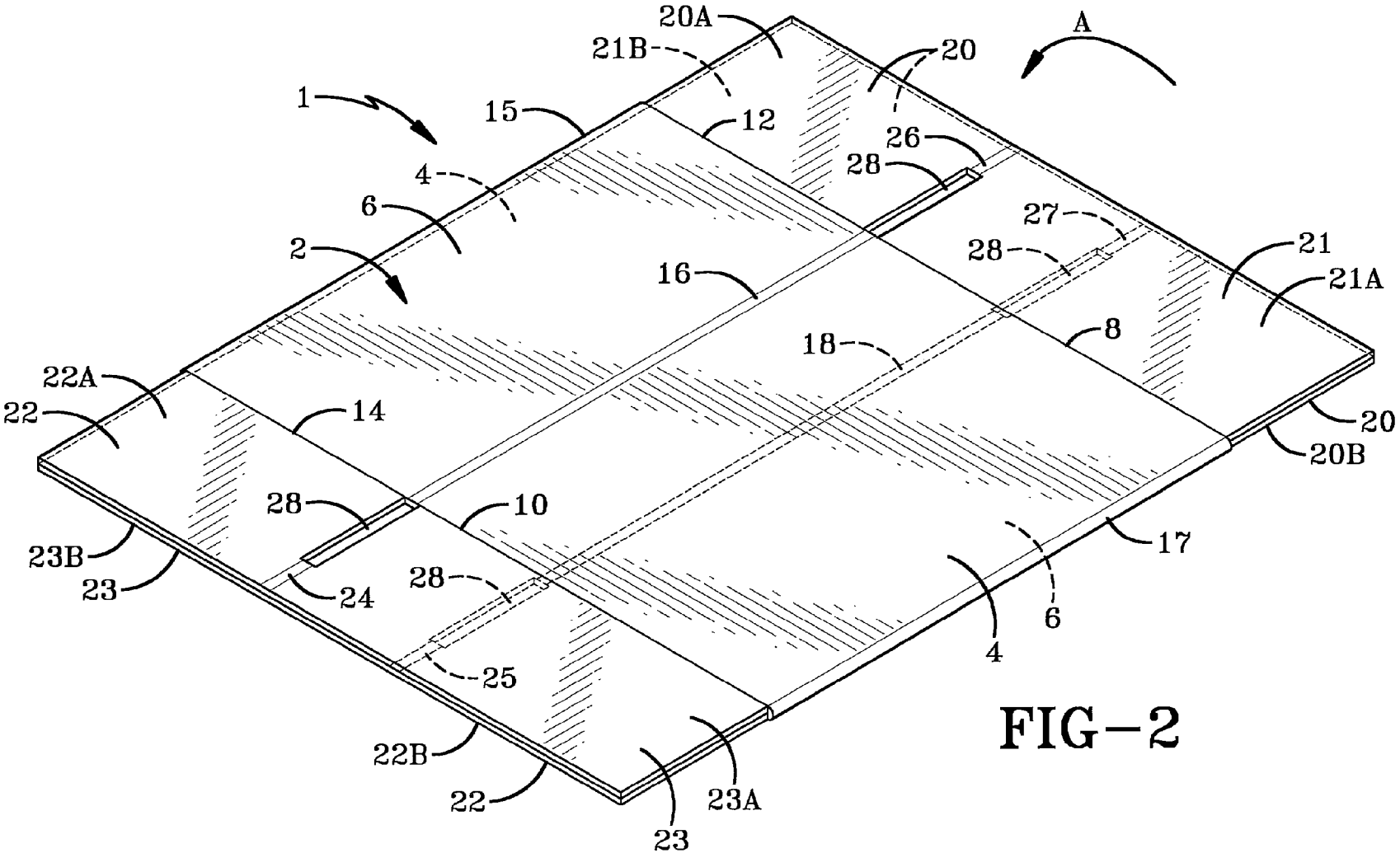
FIG. 2 is a perspective view of the box shown in FIG. 1 in the collapsed configuration.
Figure 3:
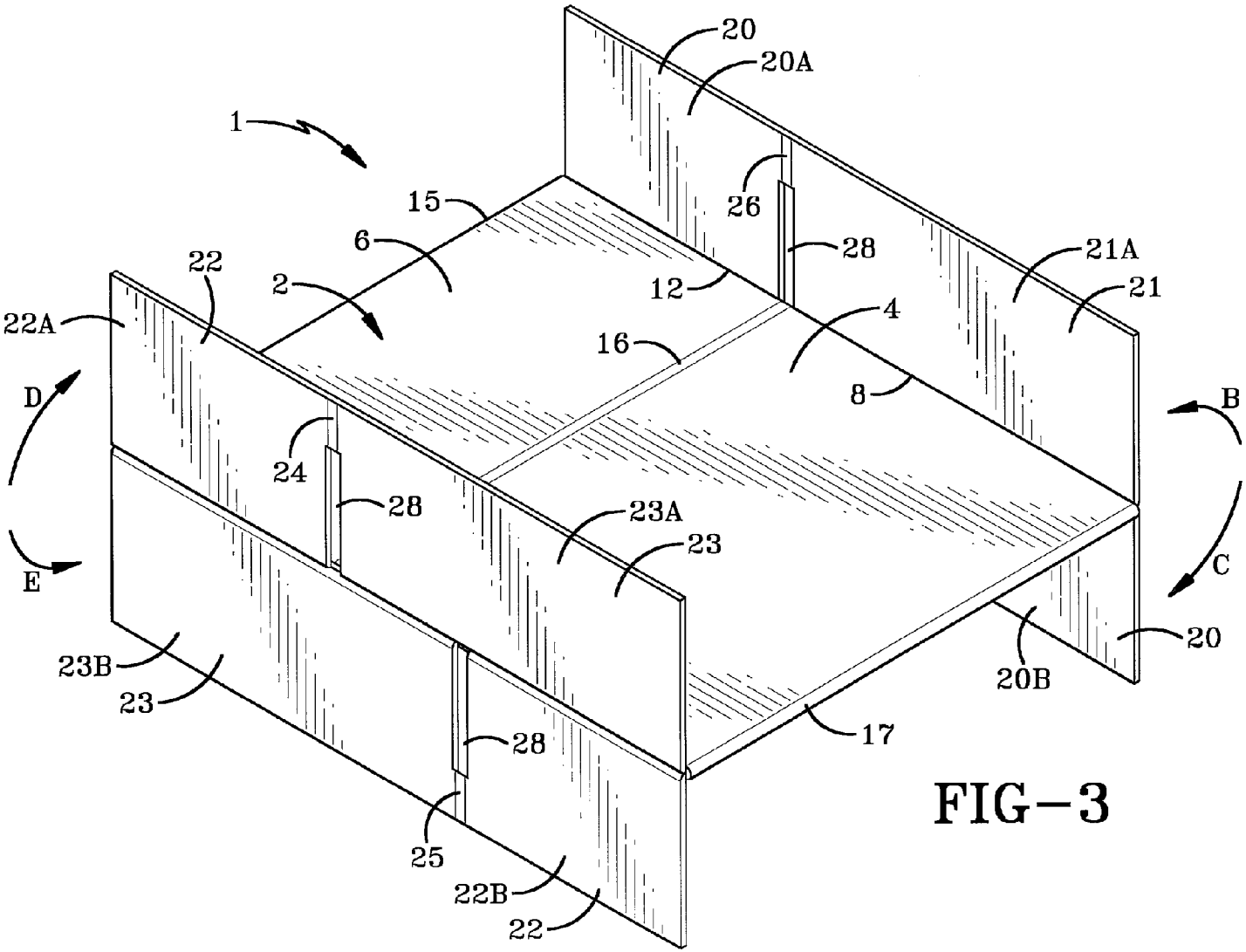
FIG. 3 is a perspective view of the box shown in FIG. 1 with the flaps moved to a second position.
Figure 4:
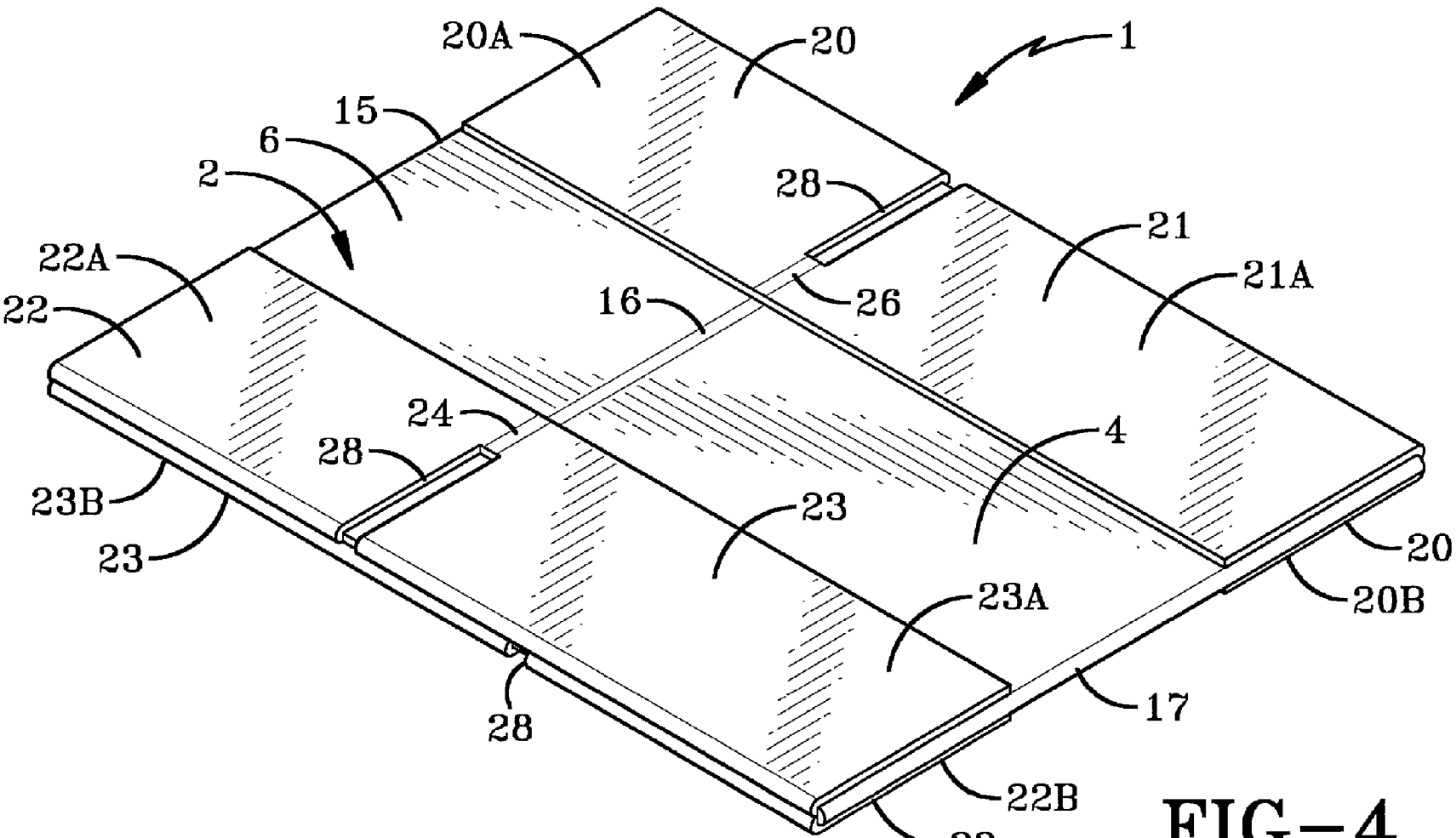
FIG. 4 is a perspective view of the box shown in FIG. 1 with the flaps collapsed against the body.

In operation, box 1 may be manufactured by moving the box 1 from the position shown in FIG. 1 to the position shown in FIG. 2 by rotating box 1 in the direction of Arrow A and by flexing joints 15 and 17 to have a 180° bend associated therewith, and by allowing joints 16 and 18 to move to a substantially flat configuration shown in FIG. 2. Top flaps 20 and 21 may be then rotated along Arrows B and C, respectively, until they are in the position shown in FIG. 3 and bottom flaps 22 and 23 may be rotated in the direction of Arrows D and E, respectively, until they are moved into the position shown in FIG. 3. As flaps 20 and 21 and 22 and 23 are rotated as shown in FIG. 3, they will ultimately move to the position shown in FIG. 4 where each of flaps 20, 21, 22 and 23 are lying adjacent body 2 of box 1. Referring particularly to FIG. 4, it can be seen that first hinge 24 and second hinge 25 are positioned adjacent joint lines 16 and 18 which are substantially flat, and that third hinge 26 and fourth hinge 27 are also positioned adjacent joint lines 16 and 18 which are substantially flat. At this point, joint lines 15 and 17 include a 180° bend.

Box 1 is then rotated in the direction of Arrow F such that joints 16 and 18 are moved to the position where they have a 180° bend therein and joints 15 and 17 are substantially flat. By rotating the box along the direction of Arrow F, it can be seen that first hinge 24 and third hinge 26 also move to have a 180° bend by wrapping around joint 16 and second hinge 25 and fourth hinge 27 also provide a 180° bend by wrapping around joint 18. The force supplied by hinges 24-27 assure that top endwall flap 20, top sidewall flap 21, bottom endwall flap 22 and bottom sidewall flap 23 are all held adjacent body 2 of box 1. Hinges 24-27 provide sufficient force to assure that the free ends of each flap are also held adjacent body 2 of box 1. By so providing, box 1 may be stored in a relatively small space compared to a traditional box which allows the flaps to extend outwardly away from body 1.

Figure 6:
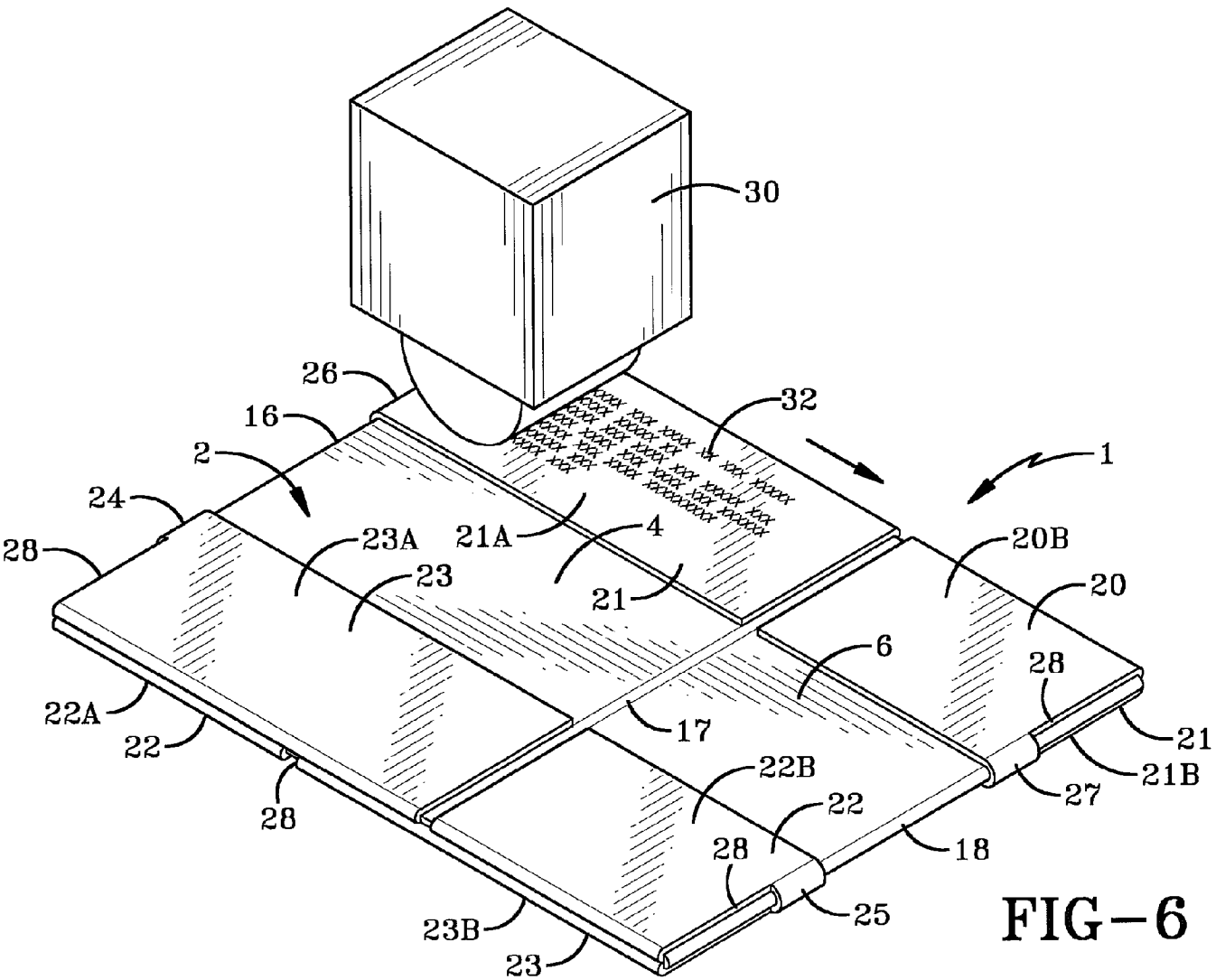
FIG. 6 is a perspective view of the box shown in FIG. 5 with a printer acting thereon.

It is often appropriate to print information such as assembly instructions or the like on a piece of packaging. Referring to FIG. 6, it can be seen that a printer 30 provides printed indicia 32 onto the interior surface of top sidewall flap 21. Inasmuch as this printed indicia 32 is on the inner surface of top sidewall flap 21, when the box is moved to the closed position as will be discussed hereinafter, this information will be positioned on the interior of the box and will not take away from the appearance of the box exterior.

Figure 7:
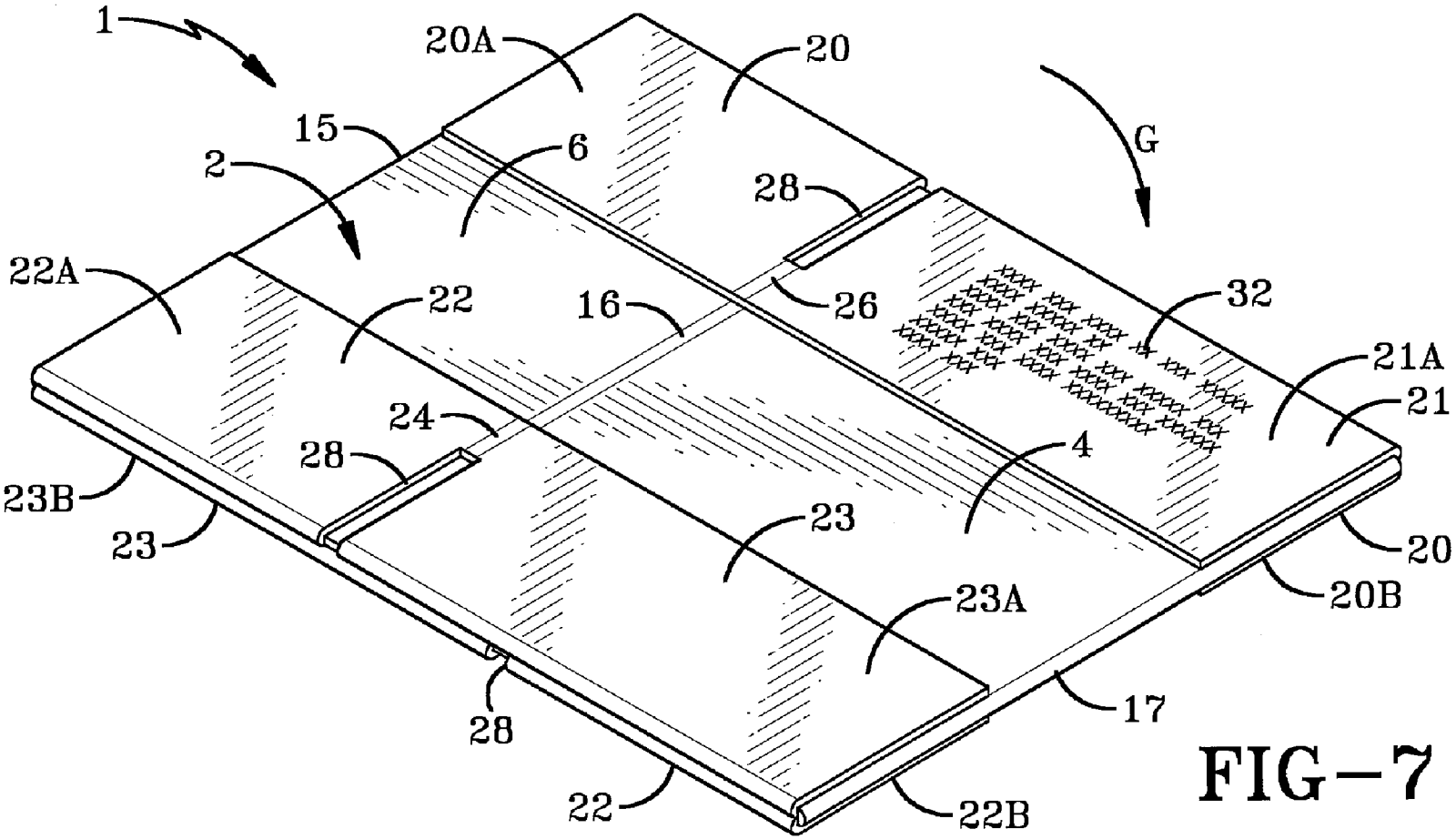
FIG. 7 is a perspective view of the box shown in FIG. 6 moved back to the position shown in FIG. 4 for opening.
Figure 8:
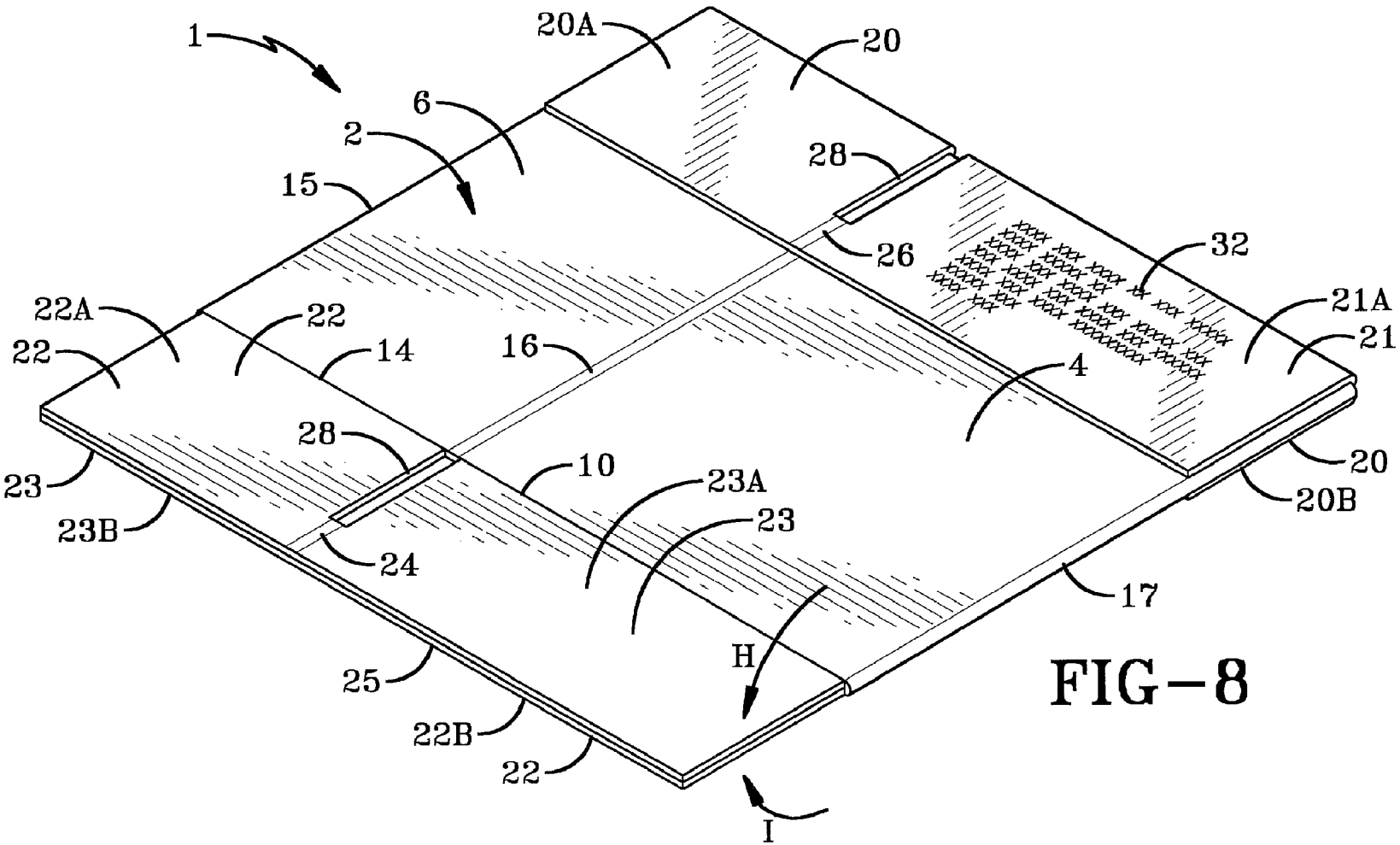
FIG. 8 is a perspective view of the box shown in FIG. 6 with the bottom set of flaps moved to the open position.
Figure 9:
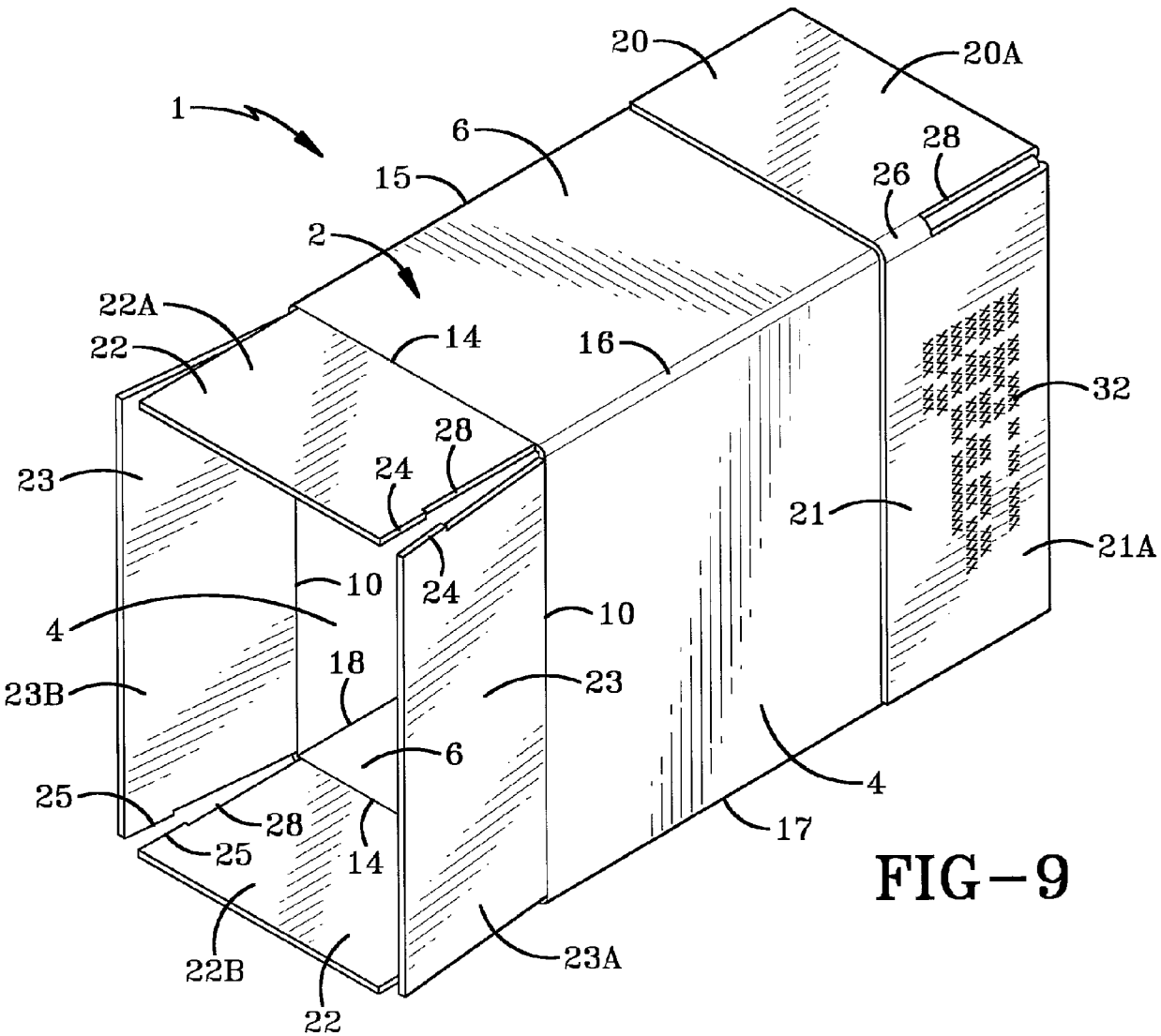
FIG. 9 is a perspective view of the box shown partially constructed.
Figure 10:
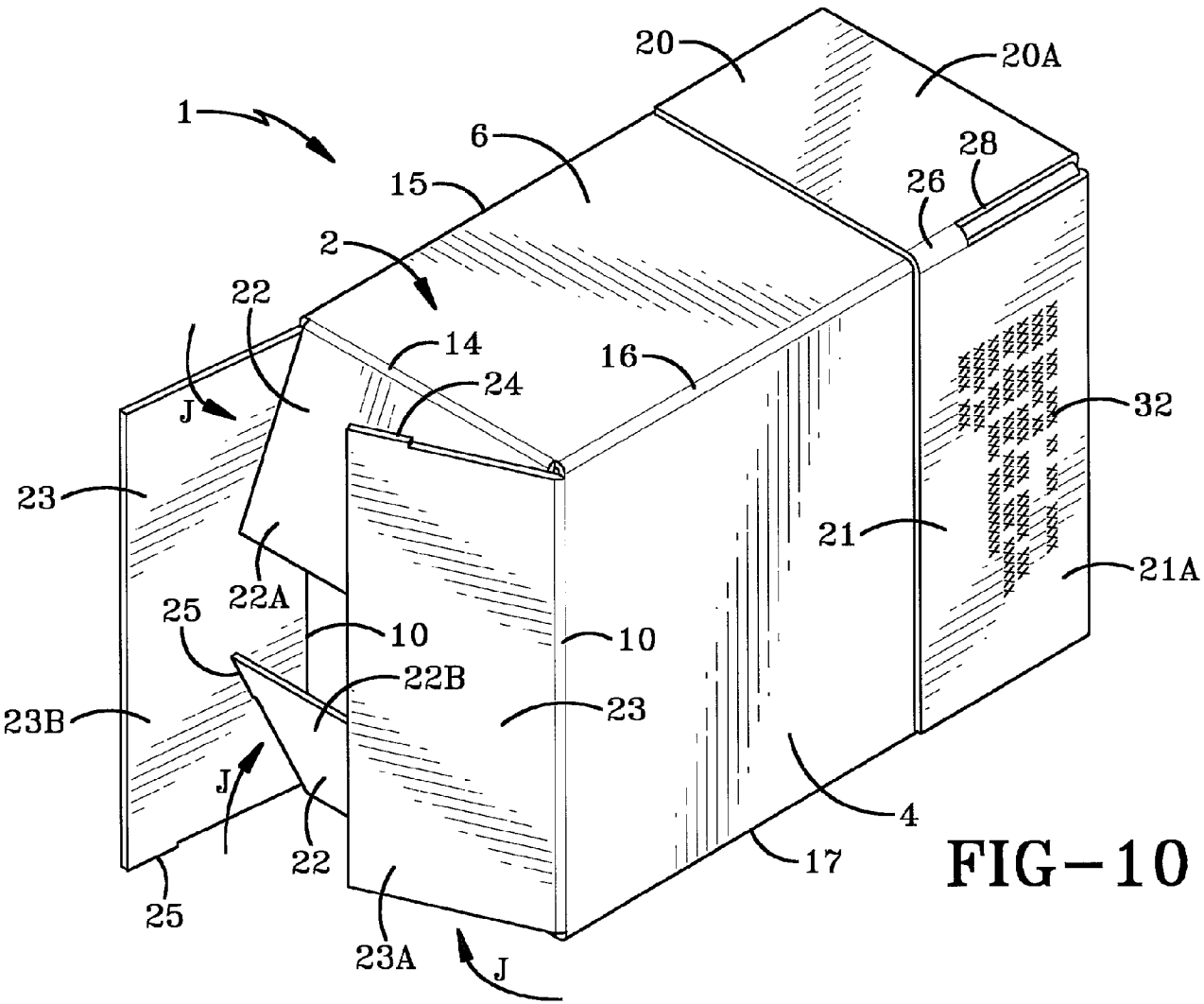
FIG. 10 is a perspective view of the box of FIG. 1 shown with the bottom of the box more fully constructed.
Figure 11:
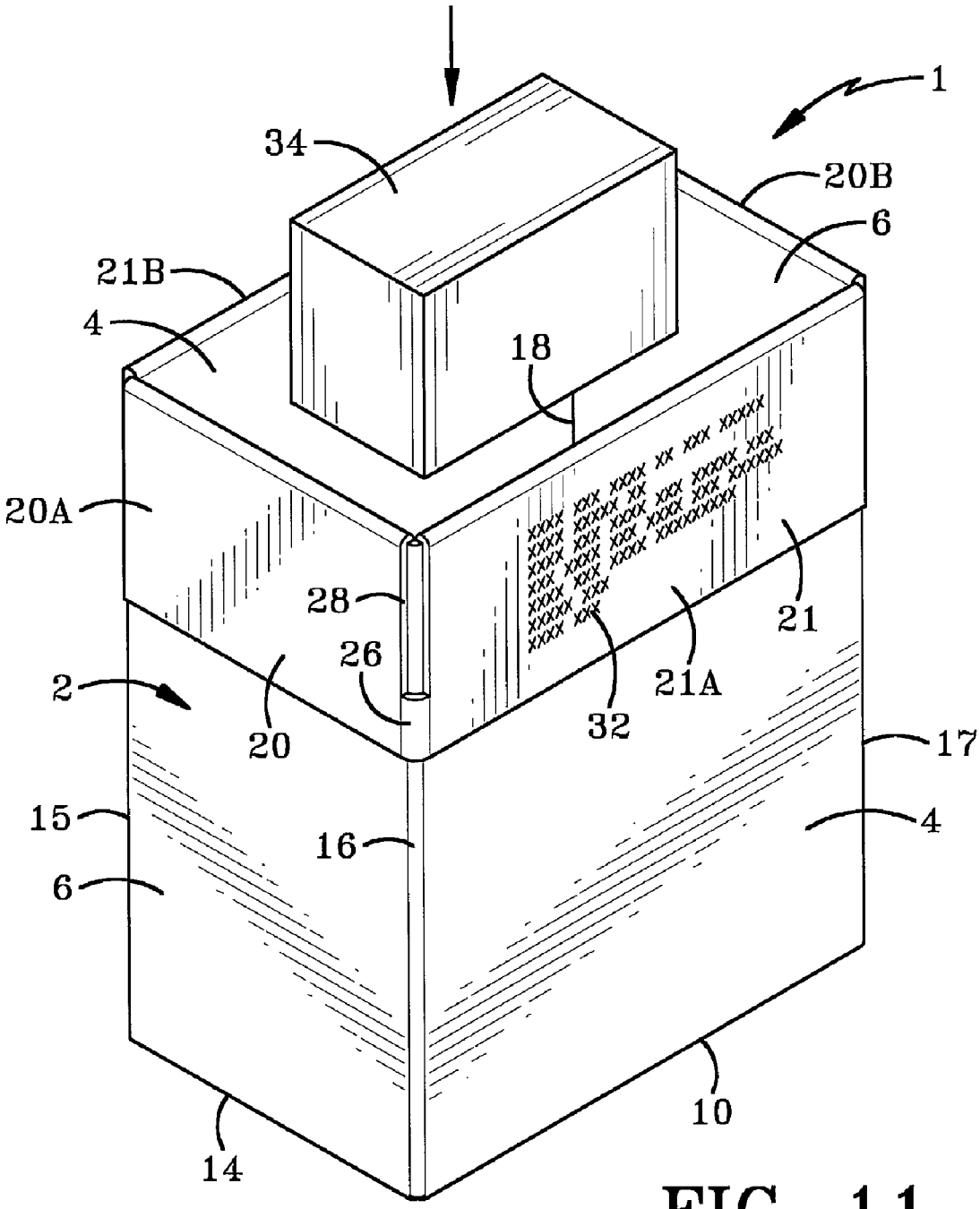
FIG. 11 is a perspective view of the box shown in FIG. 1 fully constructed and with the top flaps in the retained position.
Figure 12:
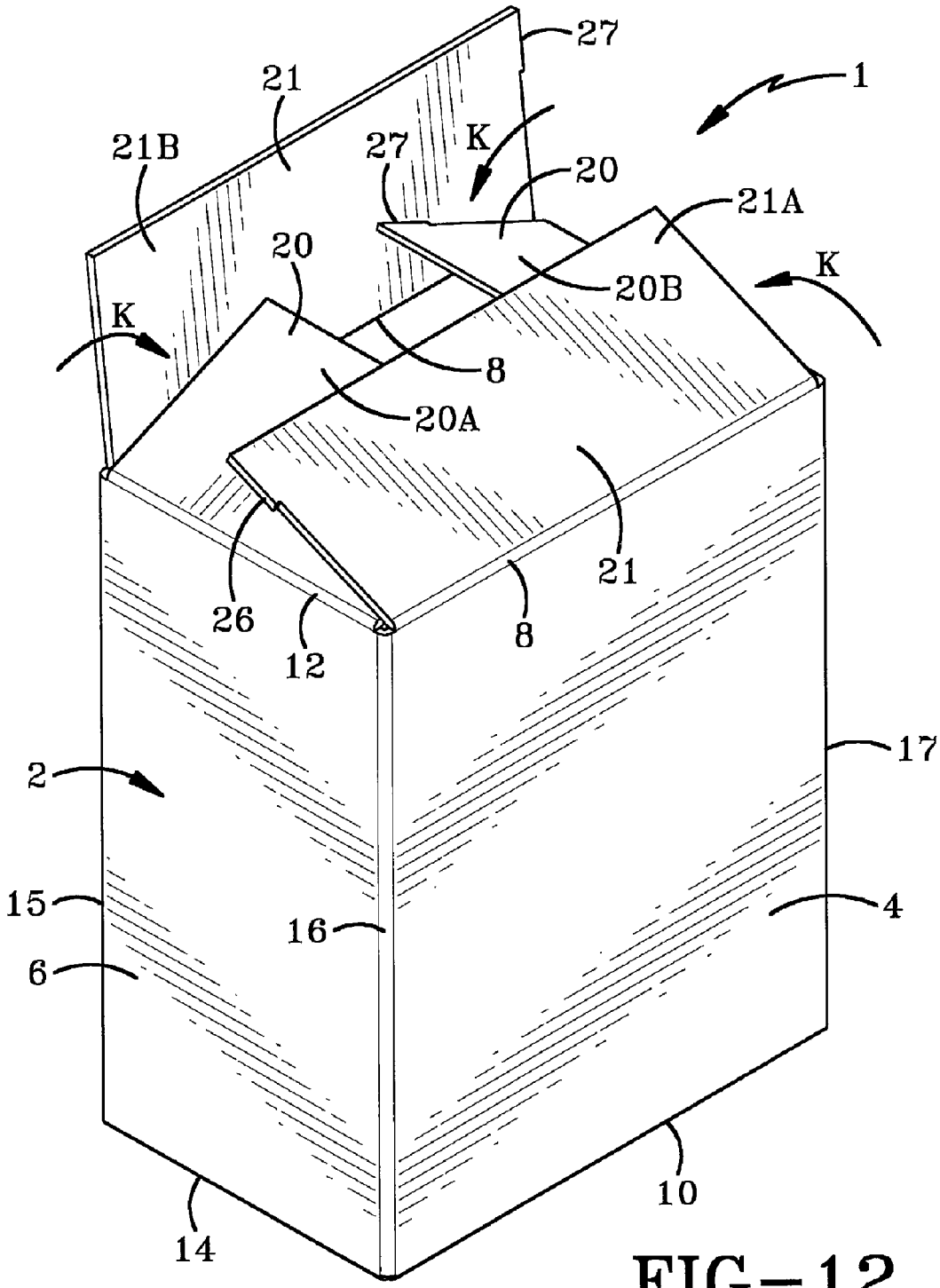
FIG. 12 is a perspective view of the box shown in FIG. 1 with the top flaps moving towards a closed position.

Referring to FIG. 7, the box, having been purchased, may now be opened and ready for use. The box is rotated along the direction shown in Arrow G, and thus looks similar to the box as it is pictured in FIG. 4 before it was moved to a position where the flaps are retained against body 2 of box 1. In this position, flaps 20A and 21A remain held adjacent body 2 and bottom endwall flaps 22 and bottom sidewall flaps 23 may be rotated downwardly in the direction of Arrows H and I as shown in FIG. 8. The box may then be moved to a partially erected state where top endwall flaps 20 and top sidewall flaps 21 stay positioned adjacent body 2 of box 1 and first hinge 24 and second hinge 25 can be broken apart to the position shown in FIG. 9. Bottom endwall flaps 22 and bottom sidewall flaps 23 can then be rotated to the closed position along Arrows J (FIG. 10). Box 10 may then be loaded with any appropriate material 34 with top endwall flaps 20 and top sidewall flaps 21 remaining positioned adjacent body 2 and held in position via third hinge 26 and fourth hinge 27. Once the box is loaded, third hinge 26 and fourth hinge 27 may be broken and top endwall flaps 20 and top sidewall flaps 21 may be rotated in the direction of Arrow K to the closed position as shown in FIG. 12. As is apparent from a review of the present invention, first hinge 24, second hinge 25, third hinge 26 and fourth hinge 27 may simply be manufactured of the same material and may be integrally formed with the box and thus manufactured out of the same material. However, hinges 24-27 could be manufactured out of material with a reduced thickness, or alternatively could be made with a fracture line formed therein to make breaking the hinge easier when in use.

As is evident from the above description and method of operation, box 1 may be stored in a relatively small space limited to only to the width of body 2 and storage need not be provided to accommodate a larger box when in the collapsed position as flaps 20, 21, 22 and 23 are all stored adjacent body 2 by way of the force supplied through hinges 24, 25, 26 and 27. As is also apparent and in accordance with one of the primary features of the invention, the interior of box 1 may be easily printed with directions or information assuring that when the box is in the closed position, there is no information on the exterior of the box to get in the way of shipping or packaging. Still further, box 1 may be loaded with top endwall flaps 20 and top sidewall flaps 21 safely secured adjacent body 2 byway of third hinge 26 and fourth hinge 27. Hinges 24, 25, 26 and 27 may all be of varying length by simply increasing or decreasing the length of free areas 28.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method of making and loading a box comprising the steps of:

(a) providing a box with:

a pair of endwalls and a pair of sidewalls, a top endwall flap extending from a top edge of each endwall and a bottom endwall flap extending from a bottom edge thereof;

a top sidewall flap extending from a top edge of each sidewall and a bottom sidewall flap extending from a bottom edge thereof;

a first hinge connecting a first one of the bottom sidewall flaps to a first one of the bottom endwall flaps;

a second hinge connecting a first one of the top sidewall flaps to a first one of the top endwall flaps;

a flexible joint extending between each adjacent pair of endwalls and sidewalls such that a first pair of said joints are flat when the box is in a first collapsed position and a second pair of said joints are bent when the box is in the first collapsed position;

(b) printing information onto one or more of the top and bottom endwall flaps and top and bottom sidewall flaps when the box is in the first collapsed position;

(c) rotating the box to a second collapsed position where the first pair of said joints are bent and the second pair of said joints are flat;

(d) rotating the bottom endwall and bottom sidewall flaps from a position adjacent the endwalls and sidewalls to a position away from the endwalls and sidewalls;

(e) erecting the box such that the sidewalls and endwalls are substantially 90° from each other;

(f) breaking the first hinge; and (g) rotating each of the bottom sidewall flaps and bottom endwall flaps through 90° to close off access to a bottom end of the box.

2. The method as defined in claim 1 comprising the further steps of:

(h) maintaining the top sidewall flaps and top endwall flaps in abutting contact with the endwalls and sidewalls;

(i) loading the box;

(j) breaking the second hinge; and (k) rotating the top sidewall flaps and top endwall flaps through 270° to close off access to a top end of the box, whereby the box is in a closed position.

3. The method as defined in claim 1 comprising the further step of weakening the first hinge prior to breaking the same.

4. The method as defined in claim 1 wherein the box provided further includes an additional first hinge connecting a second one of the bottom sidewall flaps to a second one of the bottom endwall flaps; and the method comprises the further step of breaking the additional first hinge.

5. The method as defined in claim 4 comprising the further step of providing a box where the first hinge and additional first hinge each extend across one of the joints in the first pair of said joints; and wherein the joints in the second pair of said joints are free of hinges.

6. The method as defined in claim 1 wherein the step of rotating the bottom endwall and bottom sidewall flaps from a position adjacent the endwalls and sidewalls to a position away from the endwalls and sidewalls; comprises rotating the bottom endwall and bottom sidewall flaps through 180°.

7. The method as defined in claim 1 wherein the step of rotating each of the bottom sidewall flaps and bottom endwall flaps through 90° to close off access to a bottom end of the box comprises the further step of folding the bottom sidewall flaps and bottom endwall flaps in an overlapping arrangement.

8. The method as defined in claim 1 comprising the further step of securing the bottom sidewall flaps and bottom endwall flaps together with a sealant.

9. The method as defined in claim 1 comprising the further step of rotating the top sidewall flaps and top endwall flaps through substantially 180° from the position adjacent the endwalls and sidewalls.

10. The method as defined in claim 9 comprising the further steps of:

loading the box;

breaking the second; and rotating the top sidewall flaps and top endwall flaps through 90° to close off access to a top end of the box.

11. The method as defined in claim 10 further comprising the step of folding the top sidewall flaps and top endwall flaps in an overlapping arrangement.

12. The method as defined in claim 11 comprising the further step of securing the top sidewall flaps and top endwall flaps together with a sealant.

13. The method as defined in claim 2, wherein the step of printing includes printing information onto an outwardly facing surface of one or more of the top and bottom endwall flaps and top and bottom sidewall flaps when the box is in the first collapsed position; and wherein said surface faces inwardly into an interior of the box when the box is in the closed position.

* * * * *